United States Patent [19]

Guest et al.

[11] 4,309,870

[45] Jan. 12, 1982

[54] LUBRICATING SYSTEM FOR A TURBOMACHINE INCLUDING A METHOD OF OPERATING SAME

[75] Inventors: Neil A. Guest, Jeannette; James F. Krisner, Latrobe, both of Pa.

[73] Assignee: Carrier Corporation, Syracuse, N.Y.

[21] Appl. No.: 80,641

[22] Filed: Oct. 1, 1979

[51] Int. Cl.[3] ..... F02C 7/06

[52] U.S. Cl. ..... 60/39.08; 184/6.11

[58] Field of Search ..... 60/39.08; 415/125; 184/6.11, 6.28

[56] References Cited

U.S. PATENT DOCUMENTS 3,626,693 12/1971 Guillot ..... 60/39.08

3,827,236 8/1974 Rust ..... 60/39.08

4,002,224 1/1977 Easten ..... 60/39.08

*Primary Examiner*—Louis J. Casaregola

[57] ABSTRACT

A lubrication system for a turbomachine includes a primary pump operatively connected to the rotor of the turbomachine. The system further includes independently driven stand-by pump means for maintaining lubricating oil flow to the turbomachine when the primary pump is unable to deliver the oil as required. The system further includes a by-pass connecting the primary pump outlet to the oil reservoir. The by-pass is activated for permitting oil flow from the primary pump outlet to the reservoir when the secondary oil pump is activated.

2 Claims, 2 Drawing Figures

LUBRICATING SYSTEM FOR A TURBOMACHINE INCLUDING A METHOD OF OPERATING SAME

BACKGROUND OF THE INVENTION

This invention relates to a lubrication system for a turbomachine and in particular to a system having a primary lubricating oil pump directly driven by the rotor of the turbomachine.

Generally, in turbomachine lubrication systems, the main or primary and standby or auxiliary oil pumps are independently driven through such means as electric motors. However, in some turbomachines, it has been found desirable to have the primary lubricating oil pump directly driven by the rotor of the turbomachine. At relatively low turbomachine operating speeds, the primary oil pump, when directly connected to the turbomachine rotor, cannot maintain a sufficient oil flow to meet the lubrication needs of the turbomachine. For example such minimum turbomachine operating speeds may occur during startup or shutdown of the turbomachine. As would be expected, the standby oil pump is energized during such periods of time since the auxiliary oil pump is independently driven to provide the necessary lubricating oil flow.

At other times, it may become necessary to energize the standby oil pump if the lubricating oil temperature should exceed a predetermined level to increase the relatively low temperature flow of lubricating oil from the oil sump to the portions of the turbomachine requiring same.

In either case, it has been found necessarry to maintain a flow of lubricating oil through the primary oil pump as the primary oil pump will continue to operate so long as the rotor of the turbomachine is rotating. In the absence of a minimum flow of oil through the primary oil pump the oil pump will overheat resulting in damage thereto. In essence, the pump will overheat due to the generation of frictional heat which cannot be dissipated in the absence of a continuous flow of lubricating oil.

SUMMARY OF THE INVENTION

Accordingly, it is an object of the invention to improve lubricating oil systems for turbomachinery having the primary oil pump directly connected to the rotor of the turbomachine.

It is a further object of the invention to maintain a minimum flow of oil through the primary oil pump even though the standby oil pump is activated.

These and other objects of the present invention are attained in a lubrication system for a turbomachine comprising means defining a lubricating oil reservoir; primary pump means operatively connected to the shaft of the turbomachine and having an inlet connected to the oil reservoir and an outlet connected to the portion of the turbomachine requiring lubricating oil for lubrication purposes; independently driven standby pump means having an inlet connected to the oil reservoir and an outlet connected to portions of the turbomachine requiring lubricating oil for lubrication purposes; and bypass means including valve means connected to the primary pump means outlet for connecting said outlet to said reservoir and means to activate said standby pump means including means for sensing that said primary pump means is unable to supply sufficient quantities of lubricating oil to said turbomachine, said activating means further including means to open said bypass means.

The present invention further includes a method of operating a lubricating oil system for a turbomachine having a primary lubricating oil pump operatively connected to the rotor of the turbomachine and an independently driven standby lubricating oil pump comprising the steps of sensing that the standby oil pump is activated for delivering lubricating oil from an oil reservoir to the turbomachine; and delivering at least a portion of the oil discharged from the primary oil pump to the oil reservoir in response to the sensed operation of said standby oil pump.

DESCRIPTION OF THE PREFERRED EMBODIMENT

Figure 1:
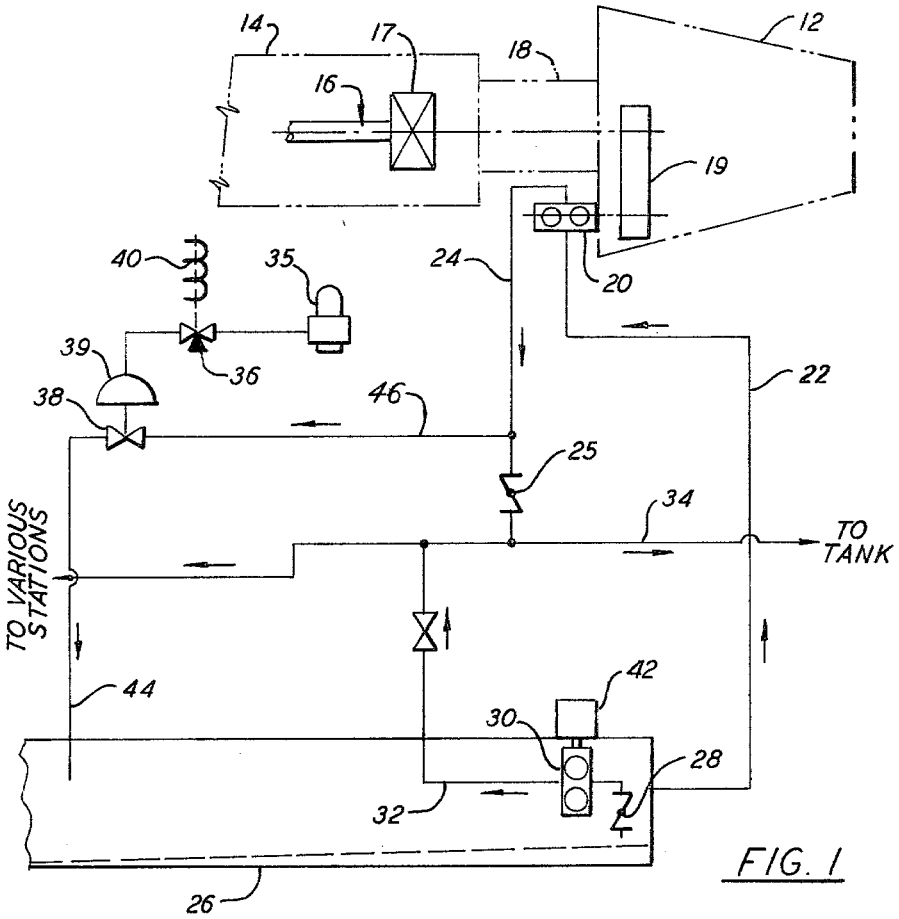
FIG. 1 schematically illustrates a lubricating oil system for a turbomachine in accordance with the present invention.

Referring now to the drawing, there is disclosed a preferred embodiment of the present invention.

The lubrication system of the present invention is preferably employed with a turbomachine such as gas turbine 12 operatively connected to compressor 14 through coupling 18. Preferably, the shafts of turbine 12 and compressor 14 are in axial alignment. Only shaft 16 of compressor 14 is illustrated in FIG. 1. Shaft 16 is supported by bearing 17.

The lubrication system specifically includes a main or primary oil supply pump 20. Lubricating oil pump 20 is connected to the rotor of the turbomachine, for example the rotor of gas turbine 12, and operates therewith. Preferably, pump 20 is connected to shaft 16 through speed reducing gear 19. Thus any time the rotor of the turbomachine is rotating. oil pump 20 will be, at least, minimally operational. The system further includes an oil sump 26 in which lubricating oil for the various operating elements, as for example journal and thrust bearings, is stored. Conduit 22 delivers lubricating oil from the sump to the inlet side of lubricating oil pump 20. Conduit 24 delivers the oil discharged from the pump to conduit 34 and thence to various connecting conduits (not shown) for eventual delivery of the oil to the operating components of the turbomachine requiring same. A check valve 25 is disposed in conduit 24 for a reason to be more fully explained hereinafter.

The lubricating oil system further includes a secondary or stand-by oil pump 30 connected to oil sump 26 through suction conduit 28. Secondary oil pump 30 is operatively connected to a motor such as electrically driven motor 42 for operation independent from the turbomachine. Conduit 32 delivers the oil discharged from secondary oil pump 30 to conduit 34. Oil flows through conduit 34 to the various connecting conduits for delivering the oil to the components requiring same.

Communicating with conduit 24 upstream of valve 25 is conduit 46 having a normally closed valve 38 mounted therein. Valve 38 includes an actuating device, such as pneumatic actuator 39, for placing the valve in its open state. Valve 38 controls the flow of oil from conduit 46 to conduit 44. Conduit 44 delivers oil flowing therethrough to oil sump 26. An electrically operated solenoid valve 36 having electrical coil 40 controls the opening of valve 38. Pressure regulator 35 controls the flow of fluid such as pressurized air provided from a source thereof (not shown), to valve 36 and thence to actuating device 39 of valve 38. When valve 36 is placed in its open position in response to energization of coil 40, fluid will pass to actuator 39 for opening valve 38.

Figure 2:
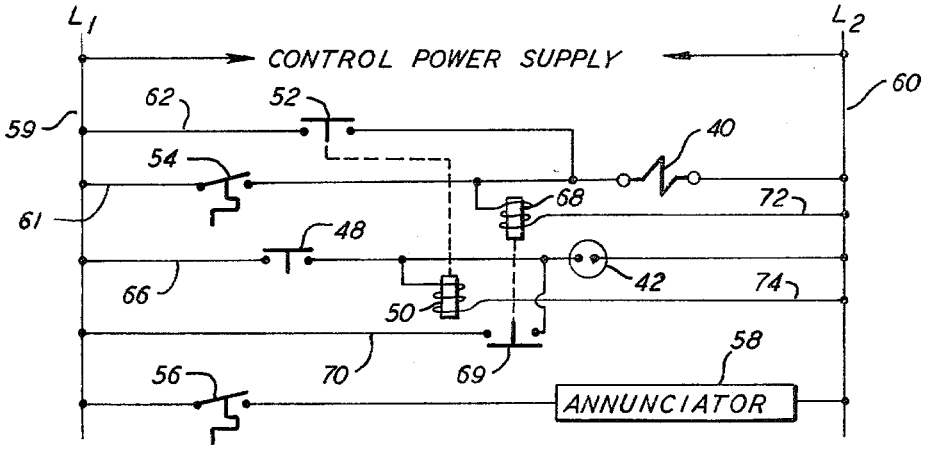
FIG. 2 schematically illustrates a control system that may be employed with the lubricating oil system disclosed in FIG. 1.

With specific reference to FIG. 2, the control system for opening valve 38 shall now be explained. The control system is preferably an electrically operated control. Lines L-1 and L-2 represent a source of electrical power connected to electrically conductive conduits 59 and 60. Electrical energy is supplied from conductor 59, conductor 61, and normally open temperature sensitive switch 54 to coil 40 of valve 36. A relay coil 68 is provided in a parallel circuit 72 with respect to coil 40. Further, electrical energy is delivered through electrical conduit 66, and normally open switch 48 to motor 42 to energize the motor for operating secondary oil pump 30. A relay coil 50 is provided in a parallel circuit 74 with respect to motor 42. Coil 50 when energized closes normally open switch 52 to provide an alternate path through conductor 62 for energizing coil 40. A switch 56 is connected in series with an annunciator, such as horn 58, for providing a signal for indicating a problem to an operating engineer. Electrical conductor 70 provides a shunt circuit to energize motor 42. Normally open switch 69 is provided in conductor 70; the switch closes when relay 68 is energized.

Primary oil pump 20 is designed to provide sufficient quantities of oil when turbomachine 12 is operating at design conditions. However, during startup or shutdown, oil pump 20, as it is directly connected to the rotor of turbomachine 12, does not rotate at sufficient speed to provide the required quantity of oil to satisfy the lubrication needs of the turbomachine. Accordingly, when primary pump 20 is incapable of delivering the requisite quantity of oil, motor 42 driving secondary oil pump 30 is energized. Further, if the oil temperature as sensed by temperature sensitive switch 54 becomes too high, motor 42 is energized through conductor 70 to drive pump 30 to deliver relatively cool oil to the seals and the bearings.

When primary oil pump 20 is operating at a relatively slow speed, as when the turbomachine is starting or stopping, pump 20 does not provide sufficient oil flow to open check valve 25. As pump 20 will continue to operate as long as the rotor of turbomachine 12 rotates the oil temperature will rise as it picks up frictional heat from the continued operation of pump 20. In essence, in the absence of the present invention, the oil will stagnate at the pump's outlet when operating conditions prevent the pressure of the oil at the outlet of pump 20 from attaining sufficient pressure to open check valve 25 to permit normal oil flow. The stagnant oil's temperature will rise so that, in time, the temperature may exceed the breakdown point for the oil. When the breakdown temperature for the oil is exceeded, the oil loses its lubricating properties.

To prevent the foregoing, the control circuit for the present invention operates to provide a by-pass flow path through conduits 44 and 46. When temperature sensitive switch 54 senses that the temperature of the lubricating oil at the outlet of pump 20 has exceeded a predetermined level, as for example 190° F., switch 54 closes to energize solenoid coil 40 and relay coil 68. The energization of coil 68 closes normally open switch 69, resulting in energization of motor 42 through electrical conduit 70. Pump 30 is thus rendered operable to deliver relatively cool oil from sump 26 to conduit 34. Once motor 42 is energized to cause secondary pump 30 to operate, pressure buildup in conduit 34 downstream of valve 25 is such that check valve 25 cannot open. However, with solenoid coil 40 energized, valve 36 open to furnish control air to operating element 39 of valve 38. With valve 38 opened, conduit 46 transmits lubricating oil from line 24 to conduit 44 and thence to the oil sump. The continued circulation of oil from pump 20 through lines 46 and 44 to sump 26 will prevent the oil from remaining stagnant at the pump's outlet, thereby preventing the oil temperature from exceeding a predetermined level.

Motor 42 and pump 30 will also be energized when the rotational speed of pump 20 and/or the rotor of turbomachine 12 has decreased below a predetermined level. Upon this occurrence, switch 48 will close energizing motor 42 and relay 50. Energization of relay 50, closes normally open switch 52 for energizing solenoid coil 40 through conduit 62. Operation of valves 36 and 38 will thence be identical to the operation of such valves during the occurrence of excessive lubricating oil temperature.

Switch 56 may also be responsive to the temperature of the lubricating oil and will also close upon excessive lubricating oil temperature. Closure of switch 56 activates annunciator 58 to signal an operator that an undesirable operating condition exists.

The present lubricating oil system prevents damage to or possible destruction of lubricating oil pump 20 through the generation of excessive lubricating oil temperatures which might occur while the pump continues to operate while it is unable to circulate lubricating oil because of excessive oil temperature and/or low discharge pressure. Basically, the invention activates a by-pass system for maintaining oil flow from pump 20 at all times that the rotor of the turbomachine is rotating irrespective of the operation of a secondary oil pump.

While a preferred embodiment of the present invention has been described and illustrated, the invention should not be limited thereto but may be otherwise embodied within the scope of the following claims.

We claim:

1. A lubrication system for a turbomachine comprising:

means defining a lubricating oil reservoir;

primary pump means operatively connected to the rotor of the turbomachine and having an inlet connected to said oil reservoir and an outlet connected to portions of said turbomachine requiring lubricating oil for lubrication purposes;

independently driven standby pump means having an inlet connected to said oil reservoir and an outlet connected to portions of said turbomachine requiring lubricating oil for purposes;

bypass means including valve means connected to the primary pump means outlet for selectively connecting said outlet to said reservoir; and means to activate said standby pump means including means for sensing that said primary pump means is unable to supply sufficient quantities of lubricating oil to said turbomachine, said activating means further including means to open said bypass means.

2. A lubrication system for a turbomachine in accordance with claim 1 wherein said means to open said bypass means includes means for sensing the temperature of the lubricating oil at said primary pump means outlet for opening said bypass means when the temperature of the oil discharged from said primary pump means through said outlet exceeds a predetermined level.

* * * * *